US005414976A

United States Patent [19]

Richards

[11] Patent Number: 5,414,976

[45] Date of Patent: May 16, 1995

[54] METHOD OF WRAPPING BOXES WITH WRAPPING PAPER

[75] Inventor: Barbara A. Richards, Matthews, N.C.

[73] Assignee: Gordon R. Richards, Matthews, N.C. ; a part interest

[21] Appl. No.: 170,039

[22] Filed: Dec. 20, 1993

Related U.S. Application Data

[63] Continuation-in-part of Ser. No. 801,497, Oct. 6, 1992, abandoned.

[51] Int. Cl.[6] ..... B65D 65/00

[52] U.S. Cl. ..... 53/449; 53/462; 229/87.19

[58] Field of Search ..... 229/87.19, 923, 87.18, 229/87.01; 493/111; 53/462, 449

[56] References Cited

U.S. PATENT DOCUMENTS

| | | | |
|---|---|---|---|
| 147,548 | 2/1874 | Beecher | 229/923 |
| 1,149,412 | 8/1915 | Smith | 229/923 |
| 1,364,897 | 1/1921 | Smith | 229/923 |
| 1,364,899 | 1/1921 | Smith | 229/923 |
| 2,365,704 | 12/1944 | James | 229/87.19 |
| 2,438,509 | 3/1948 | McGovern | 229/87.19 |
| 3,366,313 | 1/1968 | Culberg et al. | 229/87.19 |

*Primary Examiner*—Stephen P. Garbe
*Attorney, Agent, or Firm*—Bell, Seltzer, Park & Gibson

[57] ABSTRACT

Pre-cut and pre-taped sheets of wrapping paper are provided to wrap boxes of corresponding size to form packages. All sheets of the pre-cut paper include extensions that extend beyond the sides of a box being wrapped and are easily folded inwardly against the ends of the box during wrapping of the package.

2 Claims, 3 Drawing Sheets

METHOD OF WRAPPING BOXES WITH WRAPPING PAPER

This is a continuation-in-part of application Ser. No. 07/801,497, filed Oct. 6, 1992 by the applicant, Barbara A. Richards for E. Z. WRAP, now abandoned.

FIELD OF THE INVENTION

This invention relates to the packaging of containers.

BACKGROUND OF THE INVENTION AND STATEMENT OF PRIOR ART

The conventional wrapping of packages requires a number of separate steps using a variety of wrapping materials. Specifically, a suitable box, suitable paper, and string or pressure sensitive tape for holding the paper on the box must be provided. Then, the paper must be cut to conform to the size and shape of the box. Then, the paper is folded around the box and temporarily held in place while the string or pressure sensitive tape is manipulated to fasten the paper to the box.

U.S. Pat. No. 3,366,313 issued Jan. 30, 1968 to Culberg et al. for ARRANGEMENT FOR WRAPPING PACKAGES. Culberg discloses an improvement on the aforesaid conventional wrapping of packages, the improvement comprising the pre-cutting of wrapping paper in sheets of apparently a single predetermined size and the placement of short strips of pressure sensitive adhesive at selected points on the edges of the pre-cut paper.

The strips of adhesive are initially covered with strips of correspondingly dimensioned release paper, which are individually removed to use the adhesive while forming the package and to seal the package.

Culberg discloses two embodiments of his invention. In the embodiment illustrated in FIGS. 1–5, Culberg folds the paper at about its midpoint to bring opposing edges of the paper together. The opposing edges are adhered together to form a tubular sheath. A box is inserted in the sheaf and one side of the box is urged against the folded portion of the paper. A portion of the paper adjacent the opposing edges is folded flat against a second side of the box opposite said one side and the opposing edges are then folded over the second side of the box.

In Culberg's second embodiment, illustrated in FIGS. 6–8, he again provides short strips of pressure sensitive adhesive at selected points on the edges of pre-cut rectangular sheets of paper. But, in the second embodiment, Culberg forms the package in the usual way by folding one longitudinal edge of the pre-cut sheet of paper over one side of a box far enough so that said one longitudinal edge extends along the middle of the box being wrapped. The opposing longitudinal edge of the paper is then folded into overlapping relation with the first longitudinal edge portion of the paper and an adhesive strip on the second longitudinal edge is brought into contact with the first longitudinal edge portion to hold the paper around the sides of the box.

The paper is then folded over the ends of the box and held in place by removing the release paper on strips of adhesive that are provided on the pre-cut paper.

SUMMARY OF THE INVENTION

The present invention improves on Culberg by pre-cutting sheets of paper into a variety of sizes to conform with the various standard sizes of boxes, such as shirt boxes, and miscellaneous sizes of boxes.

Applicant's pre-cut sheets of paper are pre-taped with covered strips of pressure sensitive tape, and are preferably matched with boxes of corresponding size to form individual wrapping units.

Another advantage of applicant's invention over the known prior art is the inclusion of extensions on each pre-cut sheet of paper. The extensions are shaped and positioned on each sheet to fold over and extend beyond the sides of a box being wrapped. The advantage of the extensions is that they facilitate folding the paper about the ends of the box to complete the package.

Strips of pressure sensitive tape, covered with release paper, are spaced inwardly from the edges of those portions of the paper that will overlie the ends of the box. Other strips of pressure sensitive tape are spaced inwardly from the edges of those portions of the paper that will overlie the medial portion of the box.

Different sizes of applicant's pre-cut and pre-taped paper sheets may be combined and sold in a combination pack for the convenience of the user in matching a selected box with the corresponding size of applicant's pre-cut and pre-taped paper in the combination pack.

Alternatively, the pre-cut and pre-taped sheets of paper may be formed successively, with lines of perforations separating each sheet, and wrapped in a roll that is unwound and removed from the roll by the user as needed.

DETAILED DESCRIPTION OF THE INVENTION

Referring more specifically to the drawings, the numeral 10 broadly designates a pre-cut and pre-taped sheet of wrapping paper that has been formed in accordance with this invention.

The dimensions of the sheet of paper 10 are sufficiently greater than those of a selected box 11 (FIGS. 3 through 9) to permit wrapping of the box 11 with the paper 10 to form a satisfactory package.

Figure 1:
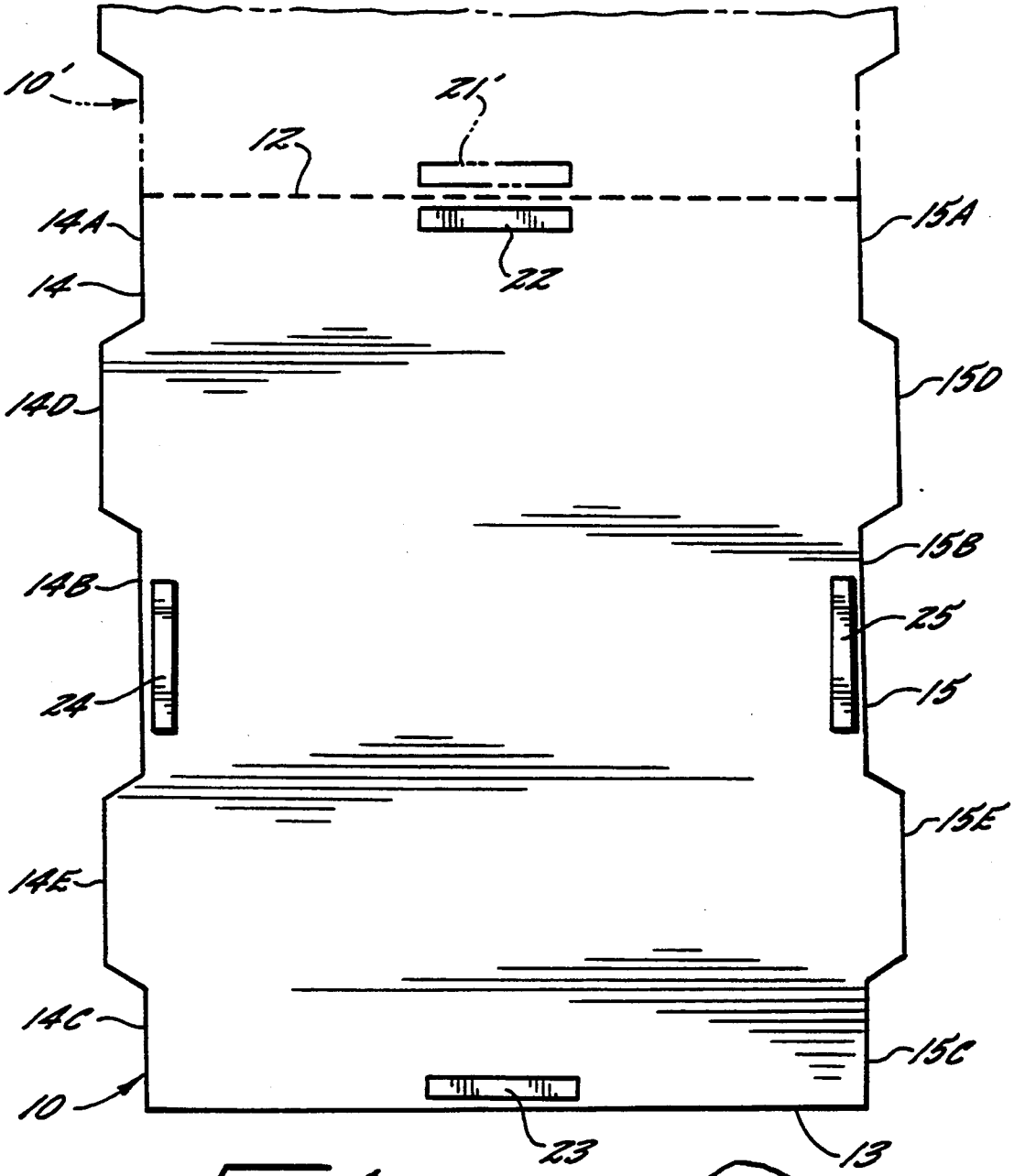
FIG. 1 is a top plan view of a pre-cut and pre-taped sheet of wrapping paper intended for a correspondingly sized box.

FIG. 1 shows the sheet of paper 10 with a perforated edge 12 separating the sheet of paper 10 from succeeding sheets of corresponding pre-cut and pre-taped paper $\mathbf{10}^1$ that have been wrapped in a roll, not shown. If desired, the sheets of paper 10 can be formed individually and separately to be packed in stacks.

Each pre-cut and pre-taped sheet of paper 10 has opposed side edges 12 and 13 and opposed end edges 14, 15. The side edges 12, 13 are spaced apart sufficiently for those edges to slightly overlap when the paper 10 is wrapped about the circumference of an appropriately sized box 11, as in FIG. 4.

Unlike the side edges 12, 13, which are cut along straight lines, parallel to each other, the end edges 14, 15 are cut along irregular lines to define alternating inner segments and outer segments.

End edge 14 has inner segments 14A, 14B and 14C, with an outer segment 14D between inner segments 14A and 14B and an outer segment 14E between inner segments 14B and 14C. End edge 15 has inner segments 15A, 15B and 15C, with an outer segment 15D between inner segments 15A and 15B and an outer segment 15E between inner segments 15B and 15C.

Figure 3:
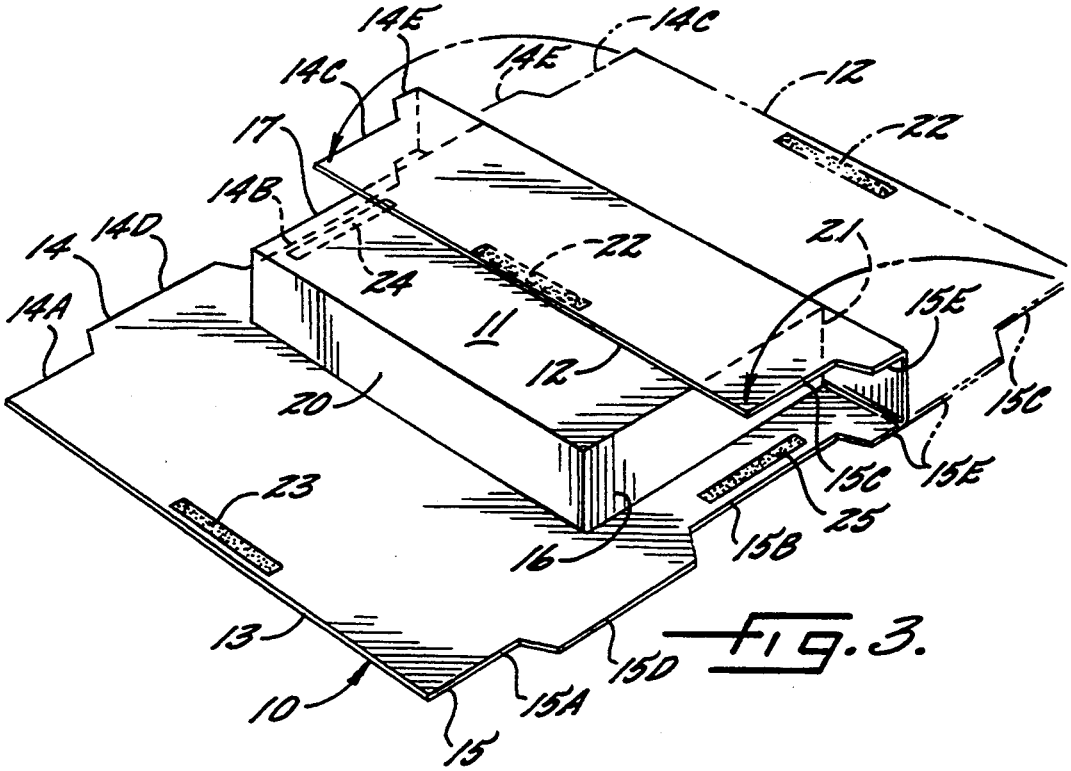
FIGS. 3 through are sequential perspective views illustrating the wrapping of a sheet of pre-cut and pre-taped paper about a correspondingly sized box.
Figure 4:
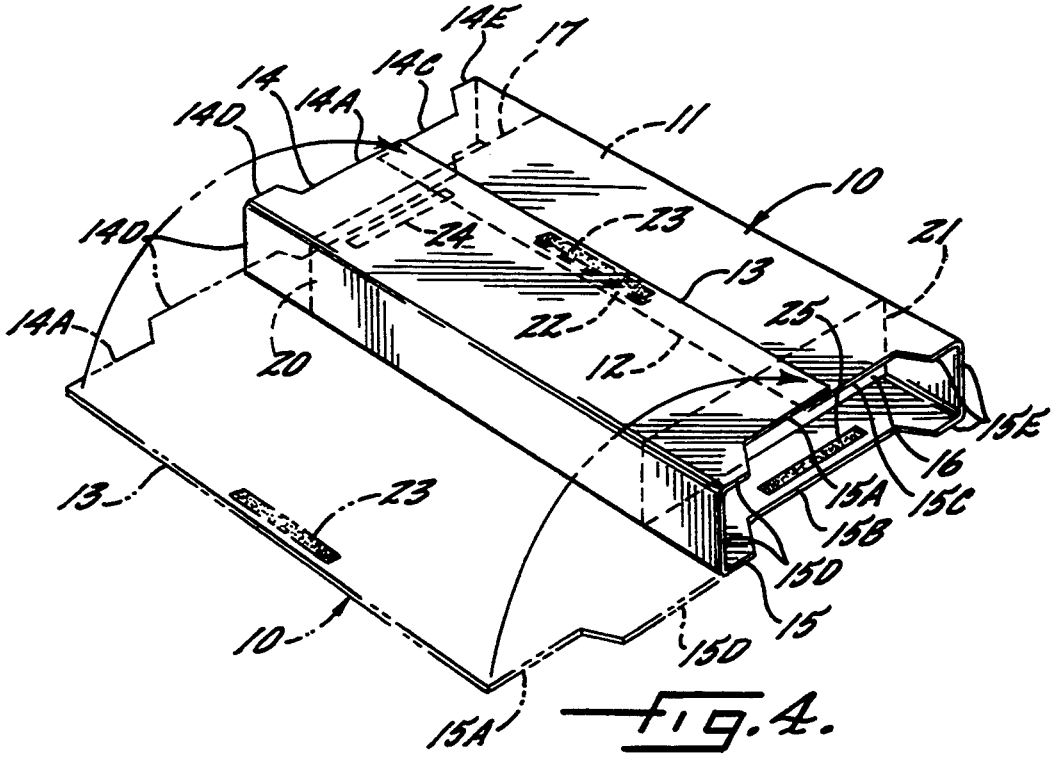

The end edges 14, 15 are spaced apart sufficiently for all segments of those edges to extend beyond opposing ends 16 and 17 of an appropriately sized box 11 when the paper 10 is wrapped about the circumference of the box 11, as in FIGS. 3 and 4.

The outer segments 14D, 14E and 15D, 15E are spaced along their respective end edges 14 and 15 to extend beyond side walls 20 and 21, respectively, of the selected box 11 when the paper 10 is initially wrapped around the circumference of the box 11, as shown in FIGS. 3 and 4.

Figure 2:
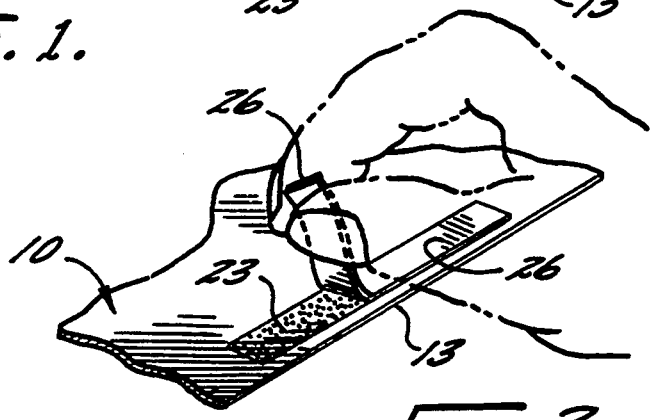
FIG. 2 enlarged fragmentary view of the lower edge of the paper in FIG. 1, with parts broken away, and illustrating the manual removal of the release paper, or protective cover, from a strip of pressure sensitive tape fastened to the pre-cut and pre-taped paper.

The paper sheets 10 are pre-cut as described for the purpose of facilitating the wrapping of a box to form a package. The wrapping of a box is further facilitated by the provision of pre-cut strips of pressure sensitive adhesive tape 22, 23, 24, and 25 strategically placed in inwardly spaced relation to respective edges 12, 13, 14, and 15. FIG. 2 shows a cover of release paper 26 overlying the pressure sensitive adhesive 23 and illustrates the manual removal of the release paper 26 when it is desired to activate the adhesive to bond the paper to a box, as in FIG. 3, or to bond the paper to itself, as in FIGS. 4 and 9. Each of the strips 22, 23, 24, and 25 are provided with a similar cover of release paper 26.

The pressure sensitive strip of adhesive 22 adheres the portion of the paper 10 adjacent the edge 12 to the box 11 during the initial wrapping of the paper about the box 11, as shown in FIG. 3. After the edge 13 of the paper 10 is brought into overlapping relation to the edge 12 of the paper 10, the adhesive strip 23 is activated to bond the edge 13 in overlying relation to the edge 12 of the paper 10 (FIG. 4).

FIGS. 5 through 8 illustrate the steps in folding the paper adjacent edge 15 into position against the end 16 of the box. The paper adjacent its edge 14 is similarly folded into position against the opposite end 17 of the box.

Figure 5:
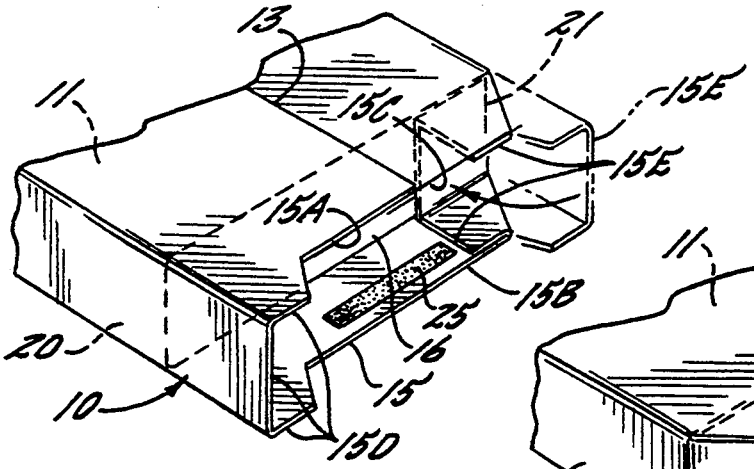
FIGS. 5 through 8 being fragmentary views, with parts broken away, illustrating the sequential steps of folding and sealing the extensions on the pre-cut paper around an end of a box.
Figure 6:
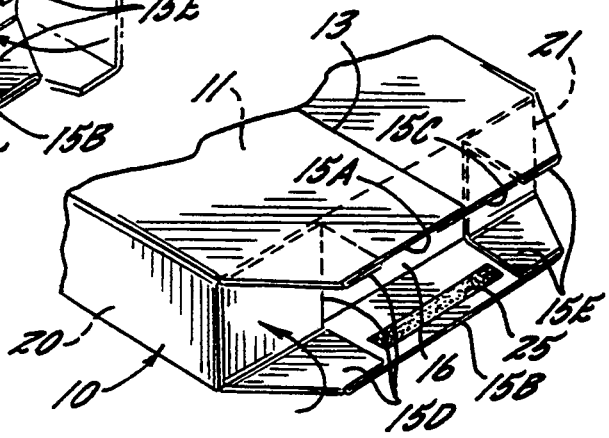
Figure 7:
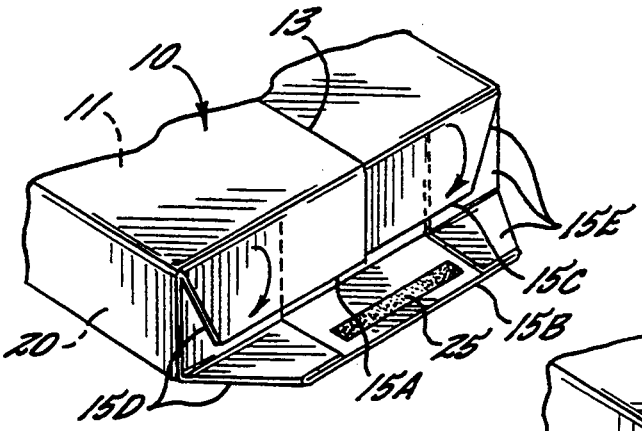
Figure 8:
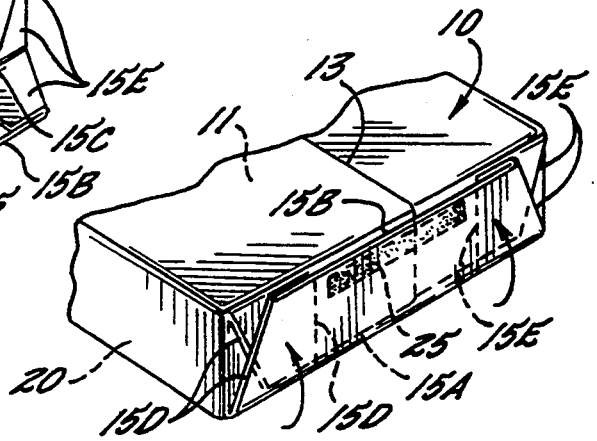

The first step in folding the paper against the ends of the box, as in FIGS. 5 and 6, is to fold the medial portions of outer segments 14D, 15D and 14E, 15E inwardly against respective ends 17, 16 of the box 11. The inner segments and the remaining portions of the outer segments are then folded into overlying relation with the medial portions of the outer segments and with the respective ends 16, 17 of the box 11 (FIGS. 6, 7, and 8).

Figure 9:
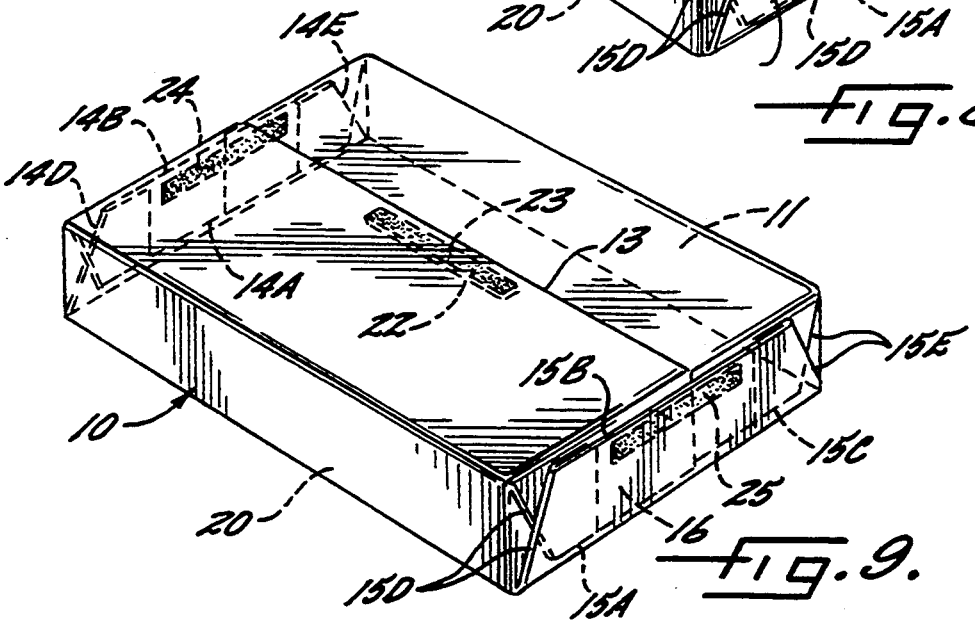
FIG. 9 is a perspective view of a completed package, wrapped in accordance with the invention.

The completed package is shown in FIG. 9.

Although specific terms have been used in describing the invention, they have been used in a generic and descriptive sense only and not for the purpose of limitation, the scope of the invention being determined by the following claims to invention when considered with this specification and the drawings and with the prior art.

I claim:

1. A method of wrapping a box with wrapping paper to form a package, said method comprising the steps of:

(a) providing a box of a selected size and having a top wall, a bottom wall, side walls and end walls;

(b) providing a sheet of wrapping paper large enough to wrap around the box and the wrapping paper including;

(i) first and second side edges that are parallel with each other and (ii) first and second end edges, each having alternating inner segments and outer segments;

(iii) strips of pressure sensitive tape covered with release paper medially located inwardly of the first and second side edges of the paper and between the outer segments at the ends of the paper;

(c) wrapping the paper around the box to place the first side edge of the paper in overlapping relation to a portion of the top wall of the box;

(d) activating the pressure sensitive tape on the first side edge of the paper to adhere the first side edge of the paper to the top wall of the box;

(e) continuing to wrap the paper around the box to place the second side edge of the paper in overlapping relation to the first side edge of the paper;

(f) activating the pressure sensitive tape on the second side edge of the paper to adhere the second side edge of the paper to the first side edge of the paper;

(g) folding the medial portions of the outer segments of the end edges of the wrapping paper inwardly against respective end walls of the box;

(h) folding the inner segments of the end edges of the wrapping paper and the remaining portions of the outer segments of the end edges of the wrapping paper into overlying relation with the medial portions of the outer segments of the end edges of the wrapping paper and into overlying relation with the end walls of the box; and (i) activating the pressure sensitive tape at the ends of the paper to adhere the end segments of the paper to each other to complete the package.

2. A method of wrapping boxes of different sizes to form packages, said method comprising the steps of:

(a) providing a supply of wrapping paper;

(b) pre-cutting the wrapping paper into sheets large enough to wrap around boxes of selected sizes;

(i) the sheets of wrapping paper each having first and second side edges that are parallel with each other and (ii) the sheets of wrapping paper each having first and second end edges with alternating inner segments and outer segments;

(c) providing a box of a selected size;

(d) providing a sheet of wrapping paper large enough to wrap around the box;

(e) wrapping the paper around the box to place the first side edge of the paper in overlapping relation to a portion of the box;

(f) continuing to wrap the paper around the box to place the second side edge of the paper in overlapping relation to the first side edge of the paper;

(g) folding the medial portions of the outer segments of the end edges of the wrapping paper inwardly against respective end walls of the box; and (h) folding the inner segments of the end edges of the wrapping paper and the remaining portions of the outer segments of the end edges of the wrapping paper into overlying relation with the medial portions of the outer segments of the end edges of the wrapping paper and into overlying relation with the end walls of the box; and (i) fastening the paper to itself to complete the package.

* * * * *